US006749024B2

(12) United States Patent
Bixenman

(10) Patent No.: US 6,749,024 B2
(45) Date of Patent: Jun. 15, 2004

(54) SAND SCREEN AND METHOD OF FILTERING

(75) Inventor: Patrick W. Bixenman, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 16 days.

(21) Appl. No.: 10/045,351

(22) Filed: Nov. 9, 2001

(65) Prior Publication Data

US 2003/0089495 A1 May 15, 2003

(51) Int. Cl.[7] ..... E21B 43/08
(52) U.S. Cl. ..... 166/278; 166/51; 166/227
(58) Field of Search ..... 166/278, 51, 227, 166/231, 233, 205, 265

(56) References Cited

U.S. PATENT DOCUMENTS

| | | | | | |
|---|---|---|---|---|---|
| 2,372,461 | A | * | 3/1945 | Uren | 166/51 |
| 3,358,781 | A | | 12/1967 | Cotton | |
| 3,431,975 | A | * | 3/1969 | Blake | 166/227 |
| 3,502,145 | A | * | 3/1970 | Du Mee et al. | 166/227 |
| 3,880,233 | A | * | 4/1975 | Muecke et al. | 166/205 |
| 3,930,538 | A | * | 1/1976 | Brennan et al. | 166/205 |
| 4,046,198 | A | * | 9/1977 | Gruesbeck et al. | 166/278 |
| 4,182,414 | A | | 1/1980 | Sanders et al. | |
| 4,317,023 | A | | 2/1982 | Gryskiewicz | |
| 4,343,358 | A | | 8/1982 | Gryskiewicz | |
| 4,343,359 | A | | 8/1982 | Krause | |
| 4,406,326 | A | | 9/1983 | Wagner | |
| 4,526,230 | A | * | 7/1985 | Kojicic | 166/51 |
| 5,095,990 | A | * | 3/1992 | Best et al. | 166/227 |
| 5,127,474 | A | * | 7/1992 | Schroeder et al. | 166/278 |
| 5,860,849 | A | * | 1/1999 | Miller | 451/40 |
| 5,901,789 | A | | 5/1999 | Donnelly et al. | |
| 6,227,303 | B1 | | 5/2001 | Jones | |

* cited by examiner

*Primary Examiner*—David Bagnell
*Assistant Examiner*—Matthew J Smith
(74) *Attorney, Agent, or Firm*—Robert A. Van Someren P.C.; Jeffrey Griffin; Brigitte Jeffery Echols

(57) ABSTRACT

This invention is a sand screen comprising a base pipe with openings cut directly thereon. The size, shape, and configuration of the openings may be varied depending on the filtration, inflow, and strength characteristics desired by the operator. The openings may be cut directly on the base pipe by use of water jet, laser, or saw cutting techniques.

15 Claims, 4 Drawing Sheets

SAND SCREEN AND METHOD OF FILTERING

BACKGROUND

This invention relates generally to equipment and tools used in subterranean wellbores for hydrocarbon recovery. Specifically, this invention relates to sand screens used in the downhole environment.

Conventional sand screens used in the downhole environment are typically made up of two main elements: a perforated base pipe and a wire wrap screen that fits over the outer diameter of the base pipe. Thus, the effective outer diameter of these conventional sand screens is the outer diameter of the wire wrap screen. Because of the inclusion of the wire wrap screen, conventional sand screens often require the selection of a smaller diameter completion than desirable in order to accommodate the sand screen and leave adequate annular space between the wellbore wall and the screen, such as, for instance, gravel pack placement. The prior art would benefit from a sand screen that does not compromise the diameter of the completion in order to leave adequate annular space between the wellbore wall and the screen, such as, for instance, gravel pack placement.

SUMMARY

This invention is a sand screen comprising a base pipe with openings cut directly thereon. The size, shape, and configuration of the openings may be varied depending on the filtration, inflow, and strength characteristics desired by the operator. The openings may be cut directly on the base pipe by use of water jet, laser, or saw cutting techniques.

DETAILED DESCRIPTION

Figure 1:
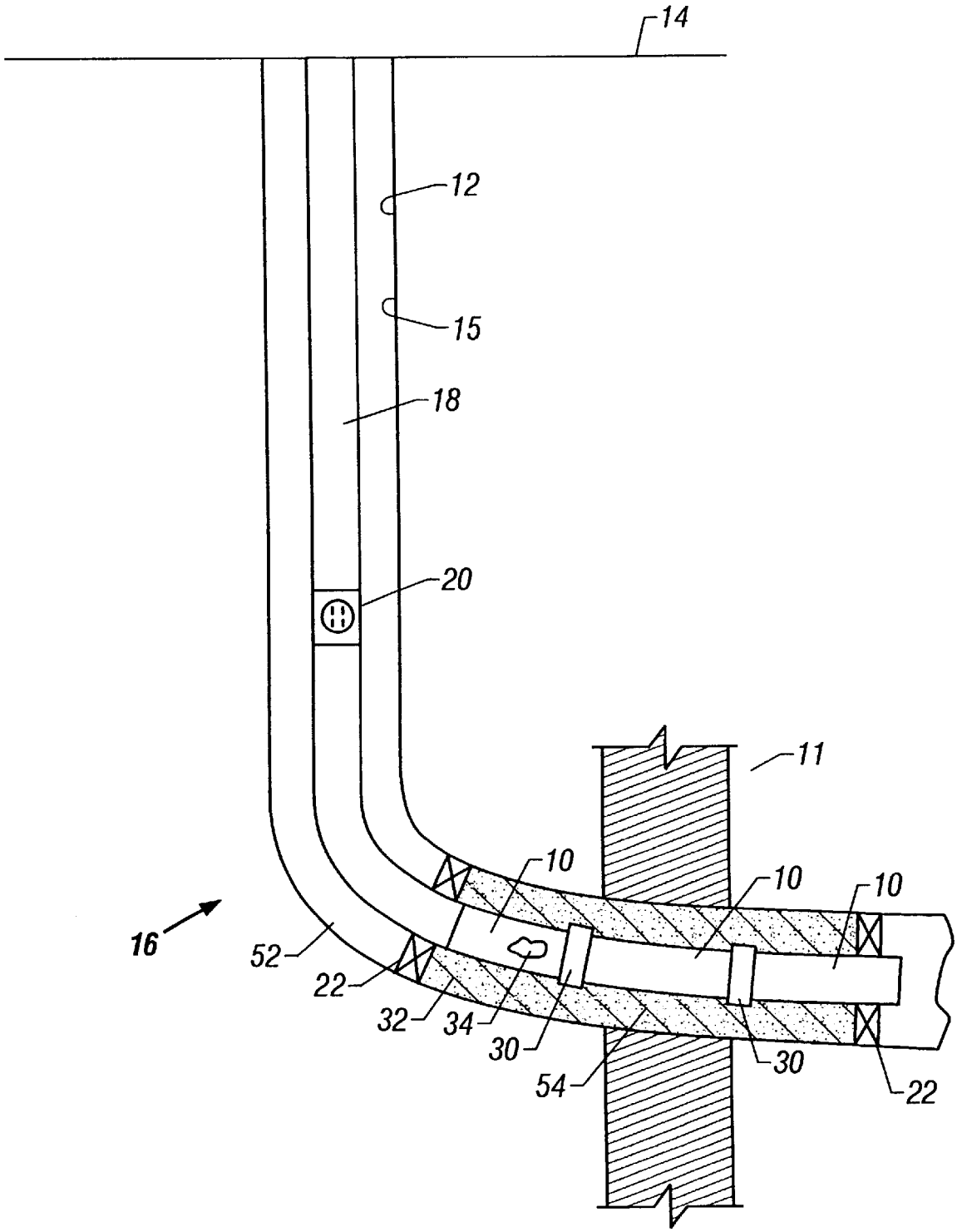
FIG. 1 is an elevational view of a wellbore including the sand screen of this invention.
Figure 2:
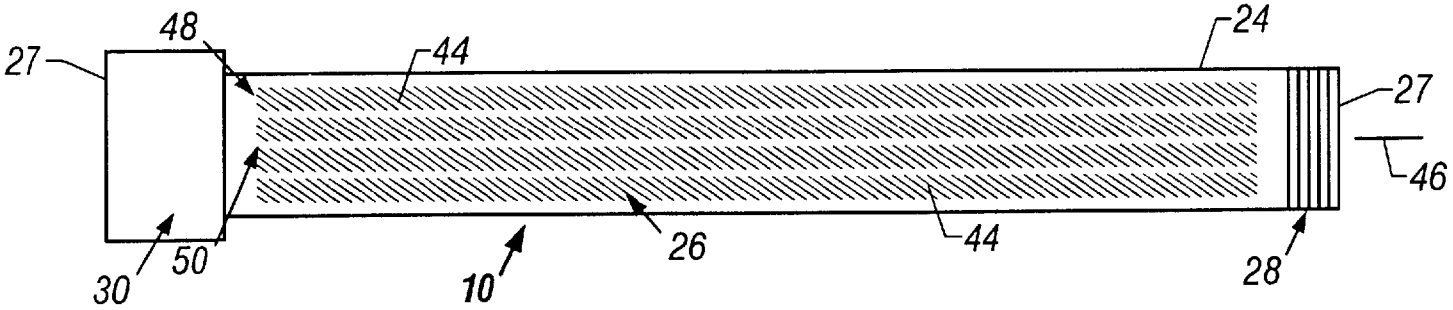
FIGS. 2–8 are elevational view of different embodiments of the sand screen of this invention.
Figure 3:
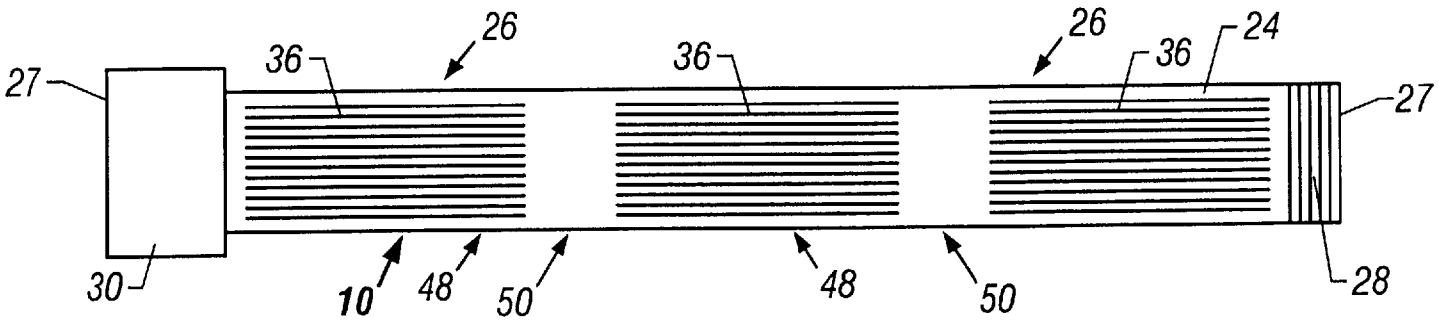
Figure 4:
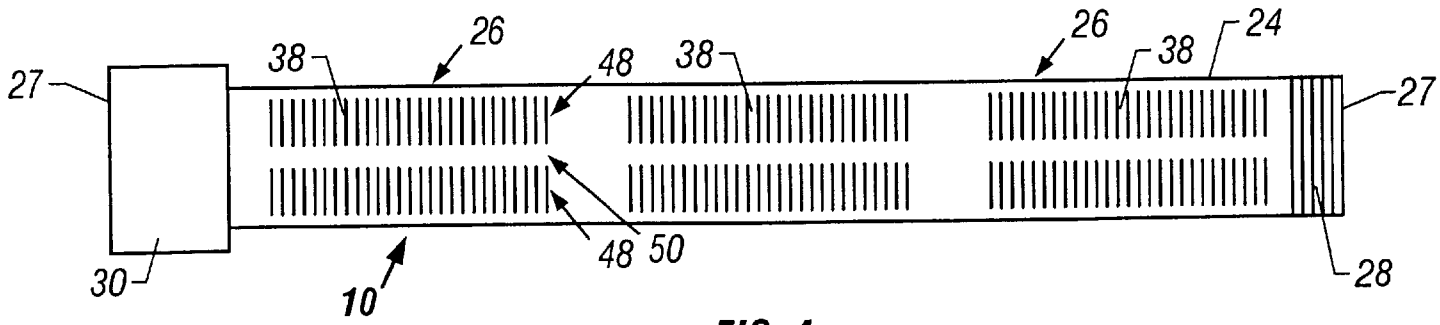
Figure 5:
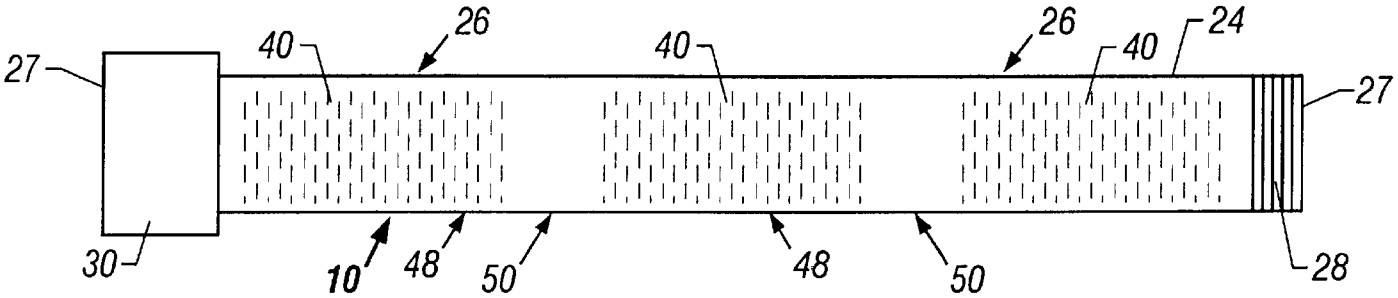
Figure 6:
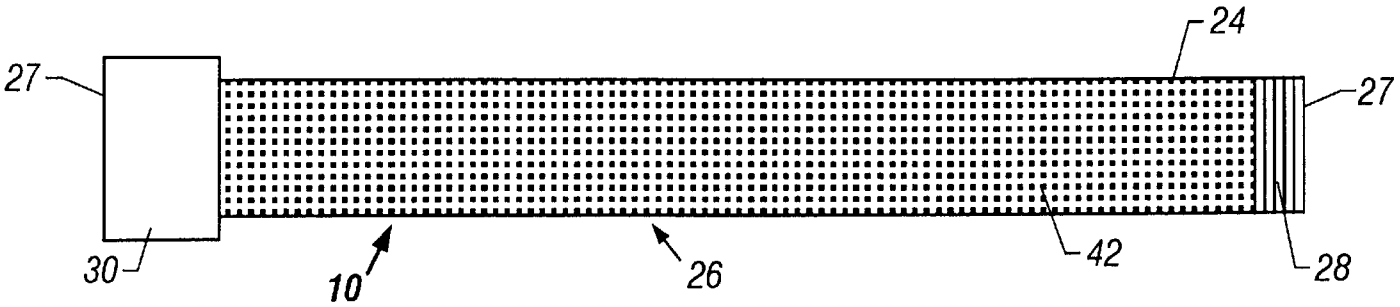

The sand screen of this invention is shown as 10 in FIGS. 1–8. As shown in FIG. 1, sand screen 10 is disposed in a wellbore 12 that extends from the surface of the earth 14. Sand screen 10 is part of a completion 16 that includes production tubing 18 and may include other sand screens 10 and downhole tools (such as valves 20 and packers 22). The wellbore 12 intersects at least one hydrocarbon formation 11. The completion 16 and production tubing 18 facilitate the transmission of hydrocarbons from the formation 11 to the surface 14. A gravel pack 54 may surround the screens 10.

As shown in FIGS. 2–8, sand screen 10 comprises a base pipe 24 and a plurality of filtration openings 26 defined on the base pipe 24. The base pipe 24 has two ends 27, each of which includes threads 28 defined thereon. A coupling 30 may be threadably attached to the threads 28 of two base pipes 24 so as to join them together (see FIG. 1). Base pipe 24 is in one embodiment constructed from a metal material, such as low alloy steel, corrosion resistant steel or other metallurgies commonly used in completion equipment in oil and gas wells. Use of a metal material is preferred in order to withstand the conditions found downhole in a hydrocarbon wellbore.

Openings 26 provide direct fluid communication between the exterior 32 and the interior 34 (see cutaway on FIG. 1) of the base pipe 24. In one embodiment, openings 26 are disposed along the length and along the circumference of the base pipe 24. Furthermore, openings 26 are sized and shaped so as to enable the passage of solid particles therethrough that are a certain size (as chosen by the operator) but prohibit the passage of solid particles therethrough that are larger than the certain size. Moreover, the number of openings 26 is chosen and the openings 26 are arranged so as to leave adequate base pipe 24 material for axial strength and collapse strength.

Figure 7:
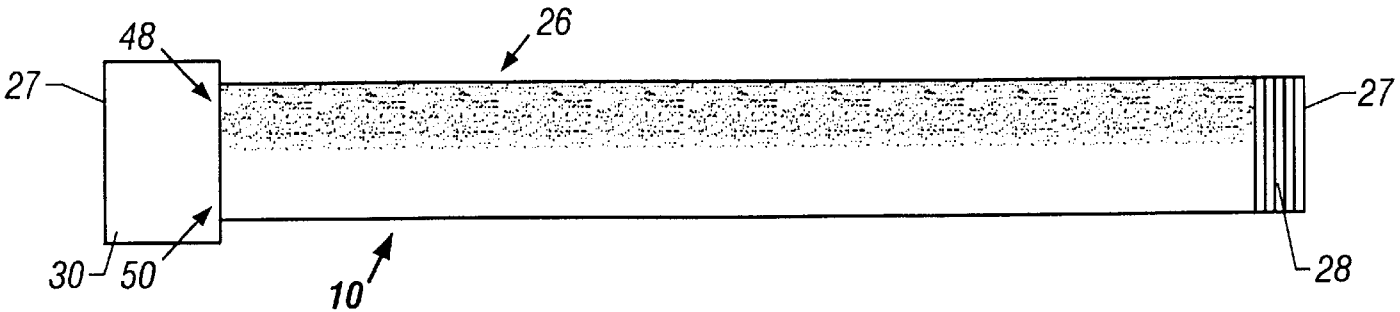

Openings 26 can have a variety of sizes, shapes, and configurations, depending on the requirements of the user, in order to provide different filtration, inflow, and strength characteristics to the sand screen 10. For instance, openings 26 can comprise long slots 36 that extend the length or partially along the length of the base pipe 24 (See FIG. 3), which would provide the sand screen 10 with good axial strength but relatively poor collapse strength. Or, openings 26 can comprise radial slots 38 that extend partially around the circumference of the base pipe 24 (see FIG. 4), which would provide the sand screen 10 with good collapse strength but relatively poor axial strength. The openings 26 can also comprise offset radial slots 40 (see FIG. 5), microholes 42 (see FIG. 6), or diagonal slots 44 extending diagonally in relation to the longitudinal axis 46 of the base pipe 24 (see FIG. 2). Or, the openings 26 can comprise a combination of any of the foregoing. In addition, the length and area of the openings 26 can be adjusted as per the operator's requirements. Moreover, openings 26 may be strategically placed on the base pipe 24 so as to leave specific filtration areas 48, on which openings 26 are located, and specific non-filtration areas 50, on which openings 26 are not located. These filtration areas 48 and non-filtration areas 50 may be separated axially (see FIGS. 3–5), circumferentially (see FIGS. 2 and 4), or a combination of the two. Moreover, the filtration areas 48 and non-filtration areas 50 may be located so that only one side of the base pipe 24 facilitates the inflow of hydrocarbons (see FIG. 7). The configuration shown in FIG. 7 is specially useful when oriented perforating has been used to perforate holes in only a certain side of the wellbore 12.

Note that sand screens 10 with different opening 26 characteristics may be used in the same completion 16. This enables a user to change the filtration and inflow characteristics along the length of the completion 16, which is sometimes beneficial such as in horizontal wells.

Openings 26 may be cut directly on base pipe 24 in the foregoing sizes, shapes, and configurations by use of laser or water jet cutting techniques. Conventional saw cutting techniques can also be used to cut the openings directly on the base pipe 24.

Figure 8:
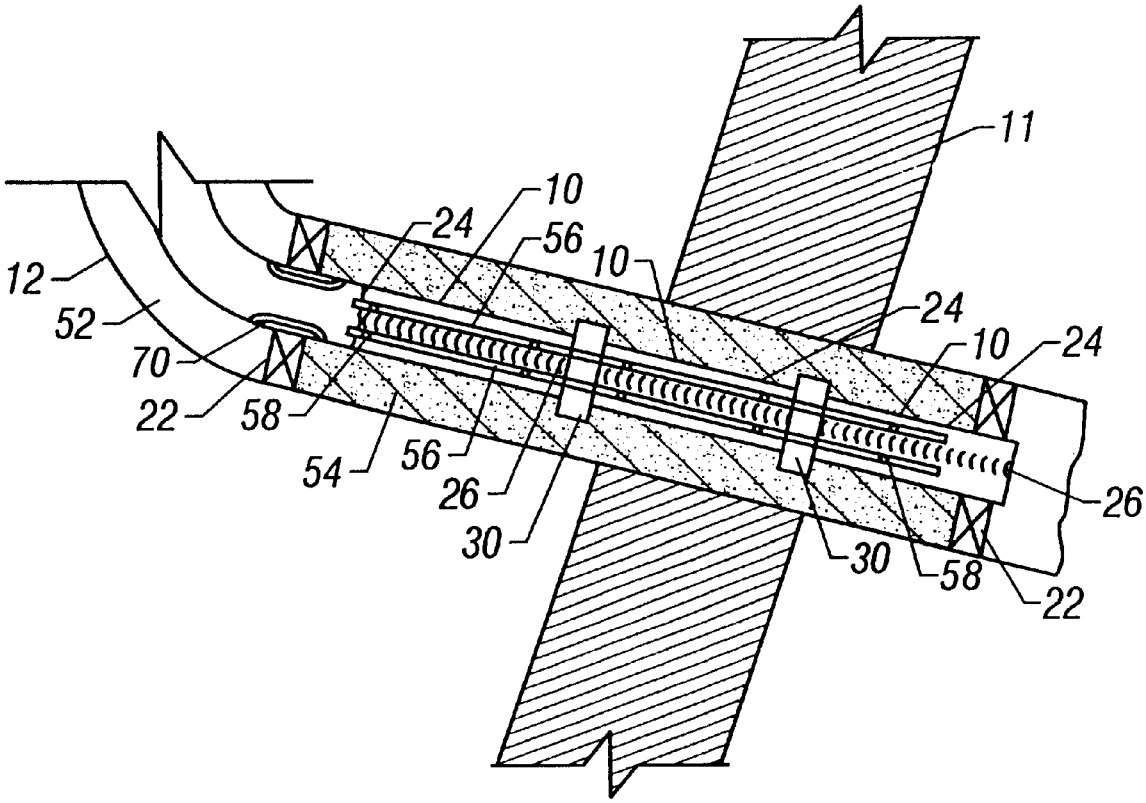

In one embodiment as shown in FIG. 8, the sand screen 10 includes tubes 56, such as shunt tubes, which may be used to transmit fluid, such as gravel pack 54 slurry, from the surface 14 into the appropriate region of the wellbore 12, such as in the annulus 52 between the two packers 22. The shunt tubes 56 of this invention are attached directly onto the base pipe 24 (without a wire wrap screen in between). On the other hand, shunt tubes in conventional sand screens are attached a distance away from the base pipe in order to provide clearance for the filtration media (wire wrap screen) located between the base pipe and the shunt tubes. Attaching the shunt tubes 56 directly on the base pipe 24 and without the filtration media in between the base pipe and the shunt tubes (since it is not needed because the openings 26 provide the filtration) saves annular space. At least one flow passage 70 provides fluid communication between the annulus 52 above the uppermost packer 22 and the annulus 52 below such packer 22. Shunt tubes 56 transport the gravel pack 54 slurry from proximate the uppermost packer 22 to locations therebelow within the annulus 52. The gravel pack 54 slurry exits the shunt tubes 56 through ports 58 placed along the length of the shunt tubes 56. Shunt tubes 56 ensure that the entire area between the packers 22 is gravel packed despite the possibility or existence of bridges.

In operation, hydrocarbons (solids and fluids) flow from the formation 11 into the wellbore 12, which may or may not include casing 15. Sand may also be produced from the formation into the wellbore 12. The hydrocarbons and sand particles pass through the annulus 52, which may include a gravel pack 54. The annulus 52 is the space defined between the completion 16 and the wellbore 12. The gravel pack 54 helps to provide mechanical support to weak formation rock and acts as a filtration media preventing larger mobilized particles from reaching the screen. When the hydrocarbons and sand particles reach the base pipe 24, the openings 26 on the base pipe 24 act as a filter to the hydrocarbons and sand particles. The openings 26 permit passage of fluids and solids under a certain size, but prohibit passage of fluids and solids over the certain size (such as sand particles). An operator selects the size, shape, and configuration of the openings 26 in order to control the filtration, inflow, and strength characteristics of the sand screen 10. Thus, the hydrocarbon fluids and the solids under the certain size pass through the openings 26 and into the base pipe interior 34, whereas the solids over the certain size (such as sand particles) remain in the base pipe exterior 32. The hydrocarbon fluids and solids under the certain size are then transmitted to the surface 14 through the completion 16 and production tubing 18.

Unlike prior art screens, sand screen 10 does not include a wire wrap screen that fits over the outside diameter of a base pipe. Fluid from formation 11 flows directly through the base pipe 24 (from the exterior 32 to the interior 34) without having to pass through another mechanism or element. And, the filtration is performed by the openings 26 formed directly on the base pipe 24. Therefore, use of the sand screen 10 provides a larger annulus 52 so that an operator does not have to compromise the diameter of the completion 16 due to the effective outer diameter of the sand screen 10 (as in prior art systems). In effect, the outer diameter of the sand screen 10 is the outer diameter of prior art base pipes, thereby saving the radial length between the prior art base pipes and their wire wrap screens.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. A screen used in a wellbore that intersects a hydrocarbon formation, comprising:

a single layer screen formed by a base pipe constructed from a metal material and having an interior through which a wellbore fluid is produced as it flows to a surface location;

the base pipe including filtration openings disposed thereon in a filtration area adjacent a non-filtration area without filtration openings, the filtration area being circumferentially segregated by the non-filtration area, wherein the base pipe is adapted to be deployed in a wellbore that is in fluid communication with a hydrocarbon formation, such that wellbore fluid flow alone the base pipe is circumferentially uninhibited.

2. The screen of claim 1, wherein the base pipe includes two ends, each of which is threaded.

3. The screen of claim 2, wherein at least one coupling threadably attaches the threaded ends of two base pipes.

4. The screen of claim 1, wherein at least one coupling attaches two base pipes together.

5. The screen of claim 1, wherein the base pipe has a length and the filtration openings comprise long slots that extend generally axially at least partially along the length of the base pipe.

6. The screen of claim 1, wherein the filtration openings comprise slots that extend partially along the circumference of the base pipe.

7. The screen of claim 1, wherein the filtration openings comprise offset slots.

8. The screen of claim 1, wherein the filtration openings comprise microholes.

9. The screen of claim 1, wherein the base pipe includes a longitudinal axis and the filtration openings comprise slots that extend in a diagonal direction in relation to the longitudinal axis.

10. The screen of claim 1, further comprising at least one tube attached to the base pipe.

11. The screen of claim 10, wherein the tube includes ports and is adapted to carry gravel pack slurry therethrough so as to deposit the slurry in an annulus exterior to the base pipe.

12. The screen of claim 1, wherein the base pipe is adapted to be surrounded by a gravel pack wherein the hydrocarbons from the formation flow into the wellbore, through the gravel pack, through the filtration openings, and into the interior of the base pipe.

13. A method of filtering the hydrocarbons flowing from a hydrocarbon formation intersected by a wellbore, comprising:

deploying a single layer screen into the wellbore, the screen comprising a base pipe constructed from a metal material, having an interior through which a wellbore fluid is produced as it flows to a surface location, and including filtration openings disposed thereon;

arranging the filtration openings on only one circumferential side of the base pipe so that hydrocarbons flow into the interior of the base pipe only through the one circumferential side without blocking any circumferential flow of hydrocarbons along the base pipe;

flowing the hydrocarbons from the formation, into the wellbore, through the filtration openings, and into the interior of the base pipe; and filtering the hydrocarbons as they flow through the filtration openings.

14. The method of claim 13, further comprising:

surrounding the screen while it is deployed in the wellbore with a gravel pack; and flowing the hydrocarbons from the formation, into the wellbore, through the gravel pack, through the filtration openings, and into the interior of the base pipe.

15. The method of claim 14, further comprising passing the gravel pack into the wellbore through at least one tube attached to the base pipe.

* * * * *

UNITED STATES PATENT AND TRADEMARK OFFICE

CERTIFICATE OF CORRECTION

PATENT NO. : 6,749,024 B2
DATED : June 15, 2004
INVENTOR(S) : Patrick W. Bixenman It is certified that error appears in the above-identified patent and that said Letters Patent is hereby corrected as shown below:

Title page,
Item [74], *Attorney, Agent, or Firm*, delete "Robert A. Van Someren P.C." and insert -- Van Someren, P.C. --.

Column 4,
Line 5, delete "alone" and insert -- along --.

Signed and Sealed this

Twenty-fourth Day of August, 2004

JON W. DUDAS
*Director of the United States Patent and Trademark Office*